US009629489B2

(12) United States Patent
Shani et al.

(10) Patent No.: US 9,629,489 B2
(45) Date of Patent: Apr. 25, 2017

(54) PASSING A BLOB FROM A CONTAINER INTO A MOUTH

(71) Applicant: JSIP, LLC, Waban, MA (US)

(72) Inventors: Nissim Shani, Waban, MA (US); Nissim Israeli, Ranana (IL); Yuval Israeli, Ranana (IL)

(73) Assignee: JSIP, LLC, Waban, MA (US)

( * ) Notice: Subject to any disclaimer, the term of this patent is extended or adjusted under 35 U.S.C. 154(b) by 0 days.

(21) Appl. No.: 14/803,959

(22) Filed: Jul. 20, 2015

(65) Prior Publication Data

US 2017/0020315 A1 Jan. 26, 2017

(51) Int. Cl.

| | |
|---|---|
| ***B65D 17/34*** | (2006.01) |
| ***A47G 19/22*** | (2006.01) |
| ***B65D 17/00*** | (2006.01) |
| ***B65D 25/20*** | (2006.01) |
| ***B65D 43/02*** | (2006.01) |
| ***B65D 71/70*** | (2006.01) |
| ***B65D 51/24*** | (2006.01) |
| ***B65D 85/72*** | (2006.01) |
| *A61J 7/00* | (2006.01) |

(52) U.S. Cl.

CPC ..... *A47G 19/2205* (2013.01); *B65D 17/163* (2013.01); *B65D 25/205* (2013.01); *B65D 43/02* (2013.01); *B65D 51/245* (2013.01); *B65D 71/70* (2013.01); *B65D 85/72* (2013.01); *A61J 7/00* (2013.01); *B65D 2543/00833* (2013.01)

(58) Field of Classification Search

CPC ..... A47G 19/2205; A61J 1/05; B65D 25/205; B65D 43/02; B65D 51/245; B65D 71/70

See application file for complete search history.

(56) References Cited

U.S. PATENT DOCUMENTS

| | | | | |
|---|---|---|---|---|
| 2,005,245 A * | 6/1935 | Stover | A23G 9/045 229/5.5 |
| 2,787,267 A | 4/1957 | Paiano | |
| 3,534,736 A | 10/1970 | Meyers | |
| 4,324,338 A | 4/1982 | Beall | |
| 4,537,311 A * | 8/1985 | Wilkinson | A61J 3/08 206/528 |
| 5,932,235 A | 8/1999 | Ninomiya et al. | |
| 8,146,747 B2 * | 4/2012 | Luciano, Jr. | G06F 19/3462 206/459.5 |
| 8,851,324 B2 | 10/2014 | O'Sullivan | |

(Continued)

OTHER PUBLICATIONS http://imgur.com/r/holdmybeer/ecdaDsr , downloaded Apr. 8, 2016, pp. 1-3.

(Continued)

*Primary Examiner* — Jeffrey Allen

(74) *Attorney, Agent, or Firm* — Fish & Richardson P.C.

(57) ABSTRACT

Among other combinations, an apparatus includes a container having two open ends; a gelled mass that includes alcohol and is in contact with an inner wall of the container to provide a seal to prevent air from passing from one of the open ends to the other open end; the inner wall being tapered to be narrower at one of the open ends than at the other, broader open end; a cover attached at the broader open end; and a cover attached at the narrower open end. The gelled mass is in contact with an inner surface of the cover attached at the narrower open end.

8 Claims, 6 Drawing Sheets

(56) References Cited

U.S. PATENT DOCUMENTS

| | | | | |
|---|---|---|---|---|
| 8,919,600 | B2 * | 12/2014 | Ferry | B65D 1/26<br>220/62.13 |
| 2011/0129588 | A1 * | 6/2011 | Marini | A23L 1/0532<br>426/575 |

OTHER PUBLICATIONS http://www.amazon.com/Suck-Blow-Jello-Shot-Pack/dp/B00139Q5SS , downloaded Apr. 8, 2016, pp. 1-7.
U.S. Appl. No. 14/828,091, filed Aug. 17, 2015, pp. 1-38.
U.S. Appl. No. 14/828,091.
Pending U.S. Appl. No. 14/828,091, filed Aug. 17, 2015.

* cited by examiner

PASSING A BLOB FROM A CONTAINER INTO A MOUTH

BACKGROUND

This description relates to passing a blob from a container into a mouth.

A blob of gelatin, for example, can be eaten from a cup by scooping the blob onto a spoon, putting the spoon into the mouth, and removing the blob from the spoon using the lips. At a wedding, for amusement, a "shot" of alcohol-spiked gelatin served in a small plastic shot glass can be scooped out of the shot glass using a utensil or a finger and then put into a guest's mouth. Another way to get the shot into the mouth uses a so-called suck and blow tube that contains the shot. One guest blows into one open end of the tube while another guest sucks on the other open end of the tube to transfer the shot into his mouth.

SUMMARY

In general, in an aspect, a container has two open ends and a blob that is edible or medicinal. The blob is in contact with an inner wall of the container. The inner wall is tapered to be narrower at one of the open ends than at the other open end.

Implementations may contain one or a combination of two or more of the following features. The blob includes a gelled mass. The contact of the blob with the inner wall of the container seals the blob against the inner wall to prevent air passing from one of the open ends of the container to the other of the open ends of the container. The blob includes an alcoholic or mixed drink. The container has a shot-glass shape. There is a sealed removable cover for the open end at which the inner wall is narrower. There is a sealed removable cover for the open end at which the inner wall is not narrower. There are scannable markings on the container or on at least one of the covers of the container, the markings including information associated with the blob. At least one of the covers is connected to a pull tab. There are other such containers, and a delivery tray contains the container and the other such containers.

In general, in an aspect, a shot glass has a wide mouthed end and an open narrower bottom end, a gelled shot of an alcoholic beverage at the bottom of the glass, and a temporary cover on the bottom end.

Implementations may contain one or a combination of two or more of the following features. The alcoholic beverage includes a mixed drink. There is a temporary cover on the top end. There is a code on the bottom temporary cover or the top temporary cover or both. There is an app on a mobile device to process data based on the code. The gelled shot is sealed against an inner wall of the shot glass to reduce the passage of air from the open narrower bottom end to the wide mouthed end. There is a space within the shot glass between the wide mouthed end and the blob. There is a an interface between an inner wall of the shot glass and an outer surface of the blob that enables the blob to be released as an integral mass from the shot glass when a user sucks on the wide mouthed end. The shot glass includes plastic. There is an annular inwardly extending lip at the open narrower bottom end.

In general, in an aspect, a container has an open wide-mouthed end and an open narrower-mouthed end and a blob containing a medicine. The blob is held in the container and obstructs air paths between the wide-mouthed end and the narrower-mouthed end. There are removable seals on the wide-mouthed end and the narrower-mouthed end.

Implementations may contain one or a combination of two or more of the following features. The wide-mouthed end is configured to enable a user's lips to be sealed around the wide-mouthed end to apply suction to the space within the container. There is an annular inwardly extending lip at the narrower-mouthed end. There is a peelable seal covering the narrower-mouthed end and attached to the lip. There is a peelable seal covering the wide-mouthed end. There is a code on the container or a seal of the container; the code is associated with information that identifies the medicine, the dosage of the medicine, or a control number or a combination of them. There is an app on a mobile device to process data based on the code. The blob includes flavoring components.

In general, in an aspect, a container has a first end, a second end, and an inner wall surface. The first end of the container is configured to permit the lips of a user to be sealed around the first end of the container to enable the user to apply a suction to a space within the container at the first end. There is a blob within the container between a first opening at the first end of the container and a second end of the container. The blob is in contact with the inner wall surface to seal the second end of the container from the space within the container at the first end. The first opening is large enough to permit the blob to pass as an integrated mass from within the container into the mouth of the user when the user applies the suction. The inner wall is larger at locations nearer the first end of the container than it is at locations farther from the first end of the container.

Implementations may contain one or a combination of two or more of the following features. There is a removable cover attached to the first end or the second end. There is another removable cover attached to the other end. There is a pull tab on one or the other or both of the removable covers. The tab is also attached to the container as a tamper indicator. The blob includes alcohol, flavorings, and a gelling agent. The blob includes a medicine and a gelling agent. There is a sealed package enclosing the container. There is a at least one additional blob in the container.

In general, in an aspect, data is received from a mobile device of a user attending an event; the data is derived from a scan acquired on the mobile device. The scan is of coded information associated with an edible blob consumed or to be consumed from a container by the user at the event. An image, a video, an audio, a text, or another item of content, or a combination of any two or more of them, captured by and received from the mobile device at the event. At a server the item of content is associated with information about the user. The received content is automatically edited to produce a presentation associated with the event and with the user. The presentation is sent to the mobile device for performance to the user on the mobile device. And the presentation to another device for presentation to another user at the event.

Implementations may contain one or a combination of two or more of the following features. The event includes a wedding, the user and the other user are guests at the wedding, the coded information identifies the wedding, and the presentation is an edited video at the wedding. The editing includes at least one of combining items of content, clipping to reduce a length of the presentation, adding music to the presentation, and adding text to the presentation. The item of content is captured by an app running on the mobile device and the item of content is sent to the server by the app. The server receives and stores from mobile devices of other users attending the event, data derived from scans acquired on the other mobile devices. The scans are of coded information associated with edible blobs consumed or to be consumed from containers by the other users at the event.

In general, in an aspect, information is received from a mobile device of the user. The information identifies an individual unit of a consumer product that has been consumed by the user of the mobile device. The information identifying the individual unit is determined based on a code scanned by the mobile device from the consumer product. Feedback is received from the user about the consumed product. Data about the user is accessed. And the information, the feedback, and the data are aggregated with such information, feedback, and data associated with other individual units of consumer products and users who have consumed them.

These and other aspects, features, and implementations and combinations of them can be expressed as methods, apparatus, systems, components, means for performing activities, software, program products, databases, methods of doing business, and in other ways.

These and other aspects, features, implementations, and advantages will become apparent from the following description and claims.

DESCRIPTION

Figure 1:
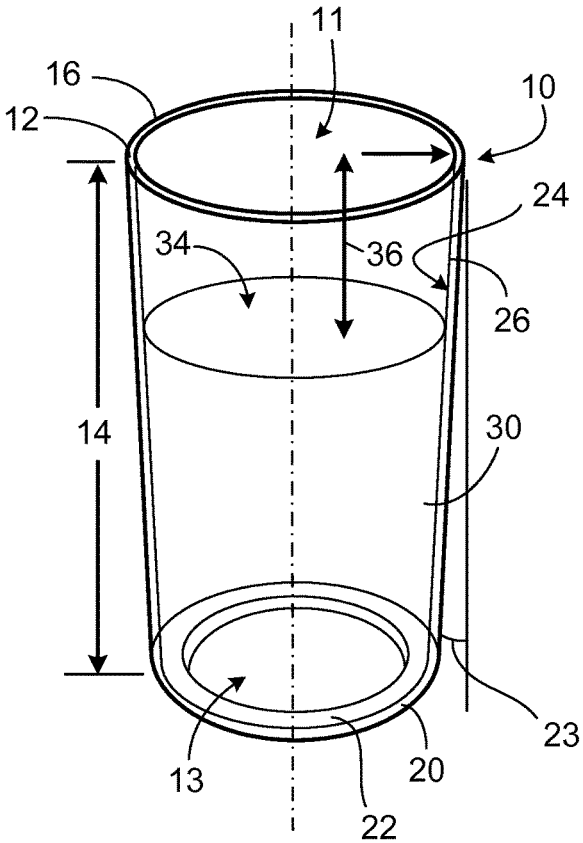
FIG. 1 is a side perspective view of a container with a blob.

Here, we describe devices and techniques for efficiently, easily, quickly, and without a mess passing blobs, such as gelled shots of liquor or mixed drinks or doses of medicine, from containers into people's mouths. When such a container has an opening in their bottom, a person can pop the gelled blob into his mouth in one step by sucking on the top of the container. The atmospheric pressure on the bottom of the blob then causes it to be released as a single mass from the inner wall of the container and to pop into his mouth. The sensation is fun and interesting, and there is no need to try to scoop the blob from the container using a finger or the tongue or a utensil.

Guests at a wedding reception, for example, can be served shot-glass style containers that contain gelled blobs of liquor. Or young children can take medicine by sucking on a cup (we sometimes use the word cup interchangeably with the word container) containing a gelled blob of the medicine. A side variety of additional features and examples will be described below.

Implementations of the concepts that we describe here can include one or more examples of each of the following (and combinations of any two or more of them): a container, a blob, a bottom cover for the container, a top cover for the container, one or more labels, packaging, ingredients, kits, software, online facilities, analytics, and other elements and combinations of them. We sometimes refer to the container and blob alone or with one or more of the bottom cover, the top cover, the labels, or the packaging a delivery unit.

We use the term "blob" broadly to include, for example, any mass of material that is not a solid or a liquid and that can maintain its integrity under certain conditions such as room temperature; the blob may, for instance, be gelled or congealed or thickened or stiffened or clotted or cohered, or a combination of them.

In some specific implementations of our concepts the blob is a gelled shot of flavored liquor or alcohol, and the container is a small plastic shot-sized cup that has both an open top and an open bottom. The open top and the open bottom are each covered by a food-safe or medicine-safe peelable seal. A label in the form of a QR code is marked on the top cover or the bottom cover or both. Each or both of the labels can also bear other markings or information.

When both the bottom cover and the top cover have been removed, a user can easily pop all or part of the gelled shot as a single integrated blob from the cup into his mouth by sucking on the top of the cup. By scanning the QR code using a smart phone, information about the shot can be fetched from the Internet or a connection can be made to online content for an event, say a wedding, at which the user has consumed the gelled shot. The QR code can also allow connection to, for example, a video production or other facility that the user can take advantage of in connection with the event or for other purposes. A tray that holds rows and columns of prefilled and sealed cups can be supplied by a manufacturer or a caterer and passed around to the guests at the wedding.

We use the term "container" broadly to include, for example, any vessel or receptacle that encloses a space where the blob can be held; the container may be, for instance, a cup, a bottle, a glass, or a vial.

In some cases, a container can be filled or partially filled with material to form one or more gelled blobs and the containers sealed and distributed by a manufacturer in large quantities, for example, a liquor or pharmaceutical maker. In some cases, the containers can be filled by a distributor or wholesaler or by a consumer in small quantities for personal or local use. The gelled blobs can be formed using combined dry ingredients that are to be mixed with liquid to form a liquid base that can then be poured into the containers and gelled in place. Packages of combined dry ingredients can be supplied in large quantities to manufacturers, wholesalers, or distributors, and in smaller quantities to caterers, restaurants, pharmacies, and consumers. Kits that include containers, labels, and combined dry ingredients can be supplied to caterers, restaurants, pharmacies, and consumers for easy use.

We now describe particular examples of each of the elements of the devices.

Container

Figure 2:
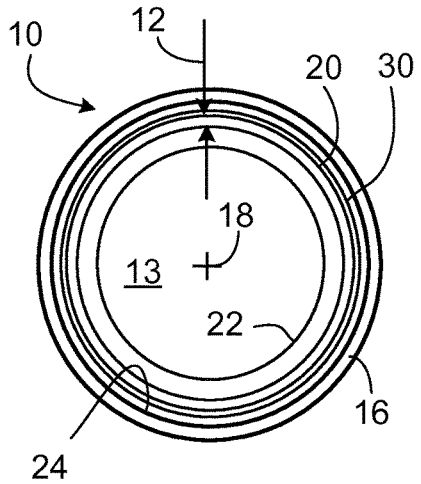
FIG. 2 is a bottom view of a container with a blob.
Figure 3:
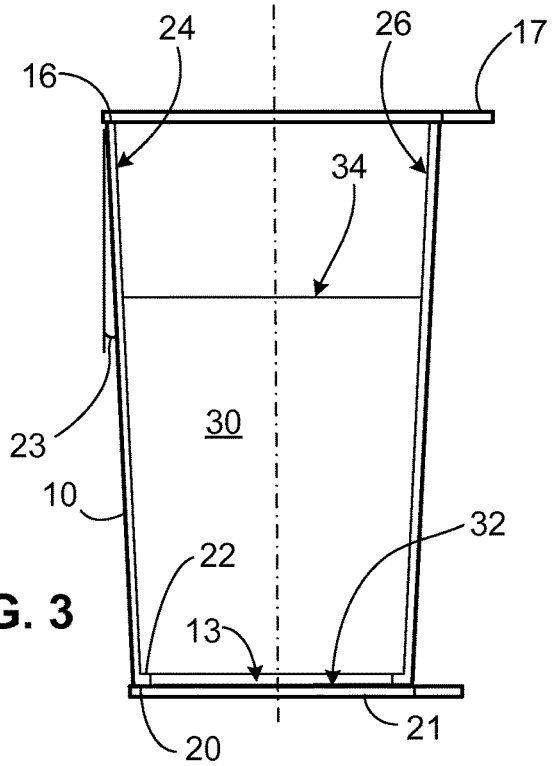
FIG. 3 is a side view of a container with the blob.

As shown in FIGS. 1, 2, and 3, in some instances, the container for the blob can be a simple tapered thin-walled round plastic cup 10 (e.g., a hollowed truncated cone) that is roughly the size and shape of a plain glass or plastic 1 ounce or 2 ounce shot glass that is open at both the top 11 and the bottom 13 of the cup. The plastic can be clear polystyrene or a wide variety of other plastics. The container (which we also sometimes call a body) can be made from a material that is intended for use in contact with food, such as any of the materials listed in FDA CFR Title 21—Part 177 or in any GRAS notice regarding material intended for use in contact with food.

The cup can be formed by molding. The wall 12 of the cup can be uniformly about 1 mm thick. The height 14 of the cup can be uniformly 60 mm. The capacity of the cup can be 35 ml of which 30 ml can be occupied by the blob.

The top 16 of the cup can be a simple round edge that defines the perimeter of the opening at the top of the cup and lies in a plane perpendicular to the vertical central axis 18 of the cup. The top 16 can have an outer diameter of 1¼ inches or 32 mm, for example. A removable label or cover 17 described later can be glued onto the top edge of the cup.

The bottom 20 of the cup can be a simple round edge that surrounds the opening at the bottom of the cup and lies in a plane perpendicular to the vertical central axis 18 of the cup. The bottom can have an integrally molded plastic circular rim or lip 22 that can project inwardly towards the vertical central axis 18 by a uniform distance of 2 mm, leaving a round opening in the bottom of the cup having a diameter of, for example, 20 mm. The total outside diameter of the bottom of the cup can be, for example, 26 mm. A removable label or cover 21 described later can be glued onto the rim or lip 22 across the bottom opening 13.

The inner surface 24 of the cup can be the untreated inner surface of the molded plastic or can be coated with a coating 26 selected to impart desired qualities to the inner surface. For example, the coating can be arranged to have an affinity for the blob in order to hold it in position within the cup until the blob is sucked out, or, conversely, to be slippery to make it easier to suck the blob out or a combination of the two.

A wide variety of other configurations, sizes, shapes, and materials and combinations of them can be used for the container. For example, the container could be metal, glass, plastic, rubber, silicone, wood, paper, cardboard, or any other material that is suitable for contact with the mouth or for containing an edible blob or a medicinal blob, or combinations of any two or more of them. The container could be formed of two or more layers, for example, a plastic inner layer and a paper outer layer, or any other combination. The container could be molded, machined, cast, extruded, stamped, wrapped, glued, cut, or formed in other ways or combinations of them. The container could be larger or smaller than the examples mentioned earlier, that is, taller or shorter, broader or narrower, or combinations of them. In some examples, the container could have other shapes than the tapered shape described earlier. The cross-section of the container could be other than round, for example, oval, or square, or free-form. The cross-section could vary with distance from the bottom of the container. The top and bottom of the cup need not be planar, but could have a wide variety of three dimensional profiles. The container could have two open ends that are not at the "top" and "bottom" of the container. One or the other of the ends or both of them could open on the sides of the container (when the bottom of the container is considered to be the side on which the container may be set down onto a surface, for example).

The container need not have only a single chamber arranged along an axis but could have two or more chambers that connect to one another at an angle, for instance.

In some cases, it is useful for the top of the container to have a size, shape, and material that are suitable to put into the mouth and that enable a user to apply suction, e.g., to a space between the top edge of the container and the top of the blob or blobs that are in the container. In some cases, it is useful for the shape and profile of the container to be arranged so that the cross-section of the container increases in size the smaller the distance from the top end or other suction opening. In this way when the user applies suction to the suction opening of the container, once the blob is released from the interior side wall of the container, the blob can pop suddenly in one mass from the container into the user's mouth. This provides a quick and easy way to transfer the blob from the container into the mouth and can be fun, unusual, and stimulating for the user, including for a child who is taking a blob of medicine or a guest at a party, for example.

In some cases, the inner wall of the container is annular and has a simple linear taper that opens out to the top end. The angle of the taper can be chosen to enable the blob to release easily from the inner wall and pop into the user's mouth. If the taper is too broad, the blob might not adhere sufficiently to the inner wall to keep it in place. If the taper makes the inner wall too nearly cylindrical, the blob may not easily release when the user sucks on the open end, or may require an unreasonable amount of suction to release the blob. In some implementations, a taper 23 of 12 degrees between the central axis 18 and the inner wall works well. In some examples, tapers in the range of 5 degrees to 15 degrees may also be particularly suitable. Nevertheless, almost any angle of taper may be used, without limit. For a typical shot glass size container having a diameter that fits well into an average mouth, and in order to provide a broad enough base at the bottom and for the container to sit stably on a surface, there may be a maximum possible angle of taper that can be achieved.

In some examples, the container need not be rigid, but could be semi-rigid or flexible or could be made of layers or sections having different degrees of rigidity.

In some implementations, it is useful for the container to have the size, shape, and material of an ordinary and familiar container such as a shot glass or a medicine bottle.

In some cases, one or two or more lines or other markings can be provided on the outside wall or inside wall or both of a container to indicate, for example, a filling height for one blob or two blobs, or to indicate the level that represents the volume of water (say 75%) or the volume of alcohol (say 25%) that could be used to form the blob or blobs in the container. Other markings could also be provided.

Blob

As shown in FIG. 1, in some implementations, the blob 30 can be a mass of a gelled drink such as an alcoholic beverage or mixed drink. The mass can contain alcohol, gelatin, flavoring, and other components of an alcoholic beverage. The blob can occupy part or all of the internal space of the cup 10 so that the bottom 32 of the blob is at the bottom of the cup and the top 34 of the blob is located at a height that leaves a space 36 between the top of the blob and the top of the cup. The space 36 can have a height of one cm for example, inches and may make it easier for the user to apply suction from his mouth to the blob to suck it into his mouth. There can be a space (not shown) between the bottom of the blob and the bottom edge of the container. There can be spaces above the blob and below the blob within the container or no spaces above or below the blob. In some implementations, by providing a space above and no space below, the blob can be made to look similar to a liquid material in the container.

A wide variety of compositions, ingredients, colors, decorations, stabilities, consistencies, and other characteristics may be imparted to the blob. In some cases, the blob can include gelatin or pectin or other thickeners or combinations of them to impart a gelled quality, rather than a liquid or solid quality, to the blob. In some instances, a blob that is gelled is flexible enough so that when suction is applied to the top of the container to reduce the pressure above or in the top space of the container, atmospheric pressure against a bottom surface of the blob is sufficient to push up on the blob and release it (e.g., suddenly) from the inner wall of the plastic cup, propelling it into the user's mouth as an integral connected mass. Ingredients of the blob can include emulsifiers, sweeteners, flavors, fragrances, medicines, and any other elements, constituents, ingredients or combinations of them that can be safely and beneficially sucked into the mouth or ingested into the stomach or both. The blob can be made to have any color or combination of colors that are possible with edible colorants and can include decorations of any kind that are edible, such as the kinds of decorations that are used on edible desserts.

Twelve different recipes for blobs and instructions for mixing and using them are set forth in the following tables. The amounts required, for example, for one delivery unit (1-shot) and for 25 delivery units (25 shots) are shown in separate columns:

Recipe 1

| Name<br>Ingredients | vodka shots<br>amount | units | 1 shot | 25 shots |
|---|---|---|---|---|
| jello powder - different taste | 85 | gram | 6.375 | 159.375 |
| water | 300 | cc | 22.5 | 562.5 |
| vodka | 100 | cc | 7.5 | 187.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | add Jello powder to boiled water |
| 2 | stirr |
| 3 | add vodka |
| 4 | stirr |
| 5 | fill glass |

Recipe 2

| Name<br>Ingredients | Daiquiri shots<br>amount | units | 1 shot | 25 shots |
|---|---|---|---|---|
| strawberry jello powder | 85 | gram | 6.375 | 159.375 |
| water | 300 | cc | 22.5 | 562.5 |
| Rom | 100 | cc | 7.5 | 187.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | add Jello powder to boiled water |
| 2 | stirr |
| 3 | add rom |
| 4 | stirr |
| 5 | fill glass |

Recipe 3

| Name<br>Ingredients | Gin and Tonic<br>amount | units | 1 shot | 25 shots |
|---|---|---|---|---|
| jello powder - different taste | 85 | gram | 6.375 | 159.375 |
| tonic water | 300 | cc | 22.5 | 562.5 |
| gin | 100 | cc | 7.5 | 187.5 |

-continued

Recipe 3

| | | |
|---|---|---|
| Vitamin B1 (Thiamine) | 5.31 | mg |
| vitamin B2 (Riboflavin) | 0.37 | mg |
| vitamin B3 (Niacin) | 9.55 | mg |
| vitamin b5 (pantothenic acid) | 1.55 | mg |
| vitamin b6 (pyridoxine) | 5.23 | mg |
| vitamin b12 (cyanocobalamin) | 8.72 | mcg |

Instructions:

| | |
|---|---|
| 1 | boil the tonic water untill there no bubbles |
| 2 | add the jello powder |
| 3 | stir |
| 4 | add gin |
| 5 | stir |
| 6 | fill glass as fast as possible |

Recipe 4

| Name<br>Ingredients | Blu Day<br>amount | units | 1 shot | 25 shots |
|---|---|---|---|---|
| jello powder - different taste | 85 | gram | 6.375 | 159.375 |
| blu day | 300 | cc | 22.5 | 562.5 |
| vodka | 100 | cc | 7.5 | 187.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | boil the blu day untill there no bubbles |
| 2 | add the jello powder |
| 3 | stir |
| 4 | add gin |
| 5 | stir |
| 6 | fill glass as fast as possible |

Recipe 5

| Name<br>Ingredients | mojito<br>amount | units | 1 shot | 25 shots |
|---|---|---|---|---|
| jello powder - different taste | 85 | gram | 6.375 | 159.375 |
| ginger ale | 300 | cc | 22.5 | 562.5 |
| rom | 100 | cc | 7.5 | 187.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | boil the ginger ale until there no bubbles |
| 2 | add the jello powder |
| 3 | stir |
| 4 | add gin |
| 5 | stir |
| 6 | fill glass as fast as possible |
| 7 | optional add a mint leaf |

Recipe 6

| Name<br>Ingredients | tequila<br>amount | units | 1 shot | 25 shots |
|---|---|---|---|---|
| jello powder - different taste | 85 | gram | 6.375 | 159.375 |
| orange juice | 300 | cc | 22.5 | 562.5 |
| Tequila | 100 | cc | 7.5 | 187.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | boil the orange juice |
| 2 | add the jello powder |
| 3 | stir |
| 4 | add Tequila |
| 5 | stir |
| 6 | fill glass as fast as possible |

Recipe 7

| Name<br>Ingredients | Lemon Drop<br>amount | units | 1 shot | 25 shots |
|---|---|---|---|---|
| jello powder - different taste | 85 | gram | 6.375 | 159.375 |
| water | 200 | cc | 15 | 375 |
| Fresh Lemon | 100 | cc | 7.5 | 187.5 |
| vodka | 50 | cc | 3.75 | 93.75 |
| triple sec | 50 | cc | 3.75 | 93.75 |
| suger | 20 | gram | 1.5 | 37.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | boil the water with the lemon juice and add the suger |
| 2 | add the jello powder |
| 3 | stir |
| 4 | add vodka and triple sec |
| 5 | stir |
| 6 | fill glass as fast as possible |

Recipe 8

| Name<br>Ingredients | Margarita<br>amount | units | 1 shot | 25 shots |
|---|---|---|---|---|
| jello powder - different taste | 85 | gram | 6.375 | 159.375 |
| Fresh squeeze lime | 60 | cc | 4.5 | 112.5 |
| water | 240 | cc | 18 | 450 |
| Cointreau | 30 | cc | 2.25 | 56.25 |
| vodka | 70 | cc | 5.25 | 131.25 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | boil the water with the lime juice |
| 2 | add the jello powder |
| 3 | stir |
| 4 | add vodka and Cointreau |

-continued

Recipe 8

| | |
|---|---|
| 5 | stir |
| 6 | fill glass as fast as possible |

Recipe 9

| Name<br>Ingredients | Midori<br>amount | units | 1 shot | 25 shots |
|---|---|---|---|---|
| jello powder - different taste | 85 | gram | 6.375 | 159.375 |
| Lemon juice | 300 | cc | 22.5 | 562.5 |
| Midori | 100 | cc | 7.5 | 187.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | boil the lemon juice |
| 2 | add the jello powder |
| 3 | stir |
| 4 | add Midori |
| 5 | stir |
| 6 | fill glass as fast as possible |

Recipe 10

| Name<br>Ingredients | Vodka<br>Red Bull<br>amount | units | 1 shot | 25 shots |
|---|---|---|---|---|
| Jello powder - different taste | 85 | gram | 6.375 | 159.375 |
| Red Bull | 300 | cc | 22.5 | 562.5 |
| Vodka | 100 | cc | 7.5 | 187.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

Instructions:

| | |
|---|---|
| 1 | boil the red bull until there no bubbles |
| 2 | add the jello powder |
| 3 | stir |
| 4 | add Vodka |
| 5 | stir |
| 6 | fill glass as fast as possible |

Recipe 11

| Name<br>Ingredients | Pina Colada<br>amount | units | 1 shot | 25 shots |
|---|---|---|---|---|
| jello powder - different taste | 85 | gram | 6.375 | 159.375 |
| Pineapple coconut juice | 300 | cc | 22.5 | 562.5 |
| Rom | 100 | cc | 7.5 | 187.5 |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

-continued

| Recipe 11 | |
|---|---|
| Instructions: | |
| 1 | boil the Pineapple coconut juice |
| 2 | add the jello powder |
| 3 | stir |
| 4 | add Rom |
| 5 | stir |
| 6 | fill glass as fast as possible |

Recipe 12

| Name Ingredients | Coffee Shot amount | units | 1 shot | 25 shots |
|---|---|---|---|---|
| jello powder - different taste | 85 | gram | 6.375 | 159.375 |
| water | 300 | cc | 22.5 | 562.5 |
| Coffee (powder/grain) | 5 | gram | 7.5 | 187.5 |
| Coffee liqueur | 100 | cc | | |
| Vitamin B1 (Thiamine) | 5.31 | mg | | |
| vitamin B2 (Riboflavin) | 0.37 | mg | | |
| vitamin B3 (Niacin) | 9.55 | mg | | |
| vitamin b5 (pantothenic acid) | 1.55 | mg | | |
| vitamin b6 (pyridoxine) | 5.23 | mg | | |
| vitamin b12 (cyanocobalamin) | 8.72 | mcg | | |

| Instructions: | |
|---|---|
| 1 | boil the water and add the Coffee |
| 2 | add the jello powder |
| 3 | stir |
| 4 | add Coffee liqueur |
| 5 | stir |
| 6 | fill glass as fast as possible |

In some cases, as shown, the formulas for the blob can include nutrients (e.g., vitamins) or other components that can reduce the intensity of a "hangover" yet remain below the amounts of such components that would require regulatory (such as FDA) approval.

In some implementations more than one blob could be included in the container. The blobs included in the container could have the same or different ingredients, colors, decorations, consistencies, and stabilities, and combinations of them. When the user sucks on the top of the container, both blobs could pop into his mouth.

Bottom Cover

Figure 4:
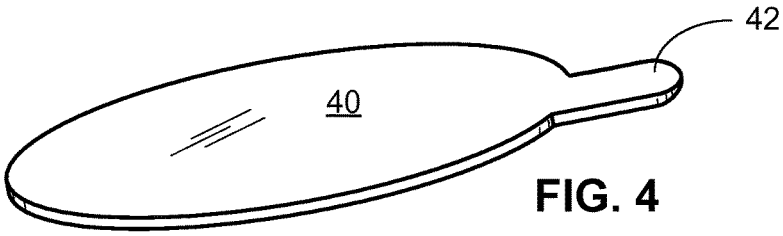
FIG. 4 is a perspective view of a bottom cover.

The bottom, and the opening in the bottom, of the cup or the top and the opening in the top of the cup, or both, can be uncovered and unobstructed (either when the cup is loaded with the blob or afterward). However, as shown also in FIG. 4, in some examples, there can be a bottom cover or seal or lid 40 in the form of a flexible round seal having the same diameter as the outer diameter of the bottom of the cup. The bottom cover 40 can be attached to the bottom of the cup using an adhesive (such as an adhesive from the FDA list found at the following link: http://www.accessdata.fda.gov/scripts/cdrh/cfdocs/cfcfr/CFRSearch.cfm?CFRPart=175&showF R=1) that provides an airtight and liquid-tight seal of the bottom of the cup against the bottom end and associated rim of the cup, and allows the bottom cover to be peeled away from the bottom of the cup when the user is ready to suck the blob out of the cup. The bottom cover of the cup can have a flexible tab 42 that can be grasped and pulled by the user in order to peel the bottom cover away from the bottom of the cup. The bottom cover can be die cut from flexible aluminum foil that has a thickness ranging from extremely thin to, for example, 1 mm thick. Similar sicknesses could apply to the top cover. The bottom cover can be made from a material that is approved for use with foods and medicines. The bottom cover (and the top cover, described below) can be made of materials suitable for use in contact with food according to FDA CFR Title 21 Part 175 and part 177 or any GRAS notice. Aluminum foil can be used and attached to the body by direct heat.

The bottom cover can have any of a wide variety of shapes, sizes, materials, layers, markings, adhesives, and tabs. In some implementations, the bottom cover can be broader than the bottom of the cup to provide a more stable surface to support the cup, for example. The bottom cover can have a different shape than the bottom of the cup, for example, a square cover for a round bottom, or a round cover for a square bottom. The bottom cover need not be flexible or peelable and need not be attached by adhesive. In some cases, the bottom cover can be rigid or semi-rigid. In some implementations, the bottom cover can be attached by a slide coupling or a screw coupling or a hinge coupling to the bottom of the cup. Any approach to providing a bottom cover that is removable or reconfigurable to allow air to reach the bottom of the blob could be used. The bottom cover can be in the form of a breakable seal or alterable seal or puncturable seal so that the seal can remain on the bottom of the cup and an opening or pathway for air to reach the bottom of the blob can be formed by an action of the user such as pushing on or otherwise manipulating all or a portion of the bottom cover. Any arrangement that covers the bottom opening sufficiently to keep the blob in place and also allows for air to pass through to apply pressure to the bottom of the blob when the user sucks on the blob can be used, including arrangements that require the user to manipulate or otherwise act on the bottom cover.

The bottom cover can have a variety of features designed to enable the bottom cover to be peeled away or removed easily. These features can include a tab 42 which can have a variety of shapes, sizes, materials, and configurations. In some cases, the tab can be arranged to provide an indication that the cup has not been opened and therefore the blob has not been replaced or adulterated. For example, the tab can take the form of a long strip that extends from the bottom cover, is bent to extend along the side wall of the cup, and extends under the top cover, or is glued over the top cover. In such configurations, if the top cover has been removed and replaced, that fact may be apparent from the fact that the tab of the bottom cover has been tampered, removed, or broken. There can be two or more tabs that are features of the bottom cover and arranged in various ways. The tab or tabs can have materials, layers, or rigidities that differ from the main part of the bottom cover.

In some examples of the bottom cover (and of the top cover, described below) there need be no tab. The cover itself can be peeled or another device or mechanism can be provided to make it easy for the user to pull off the bottom cover or top cover or both.

Figure 11:
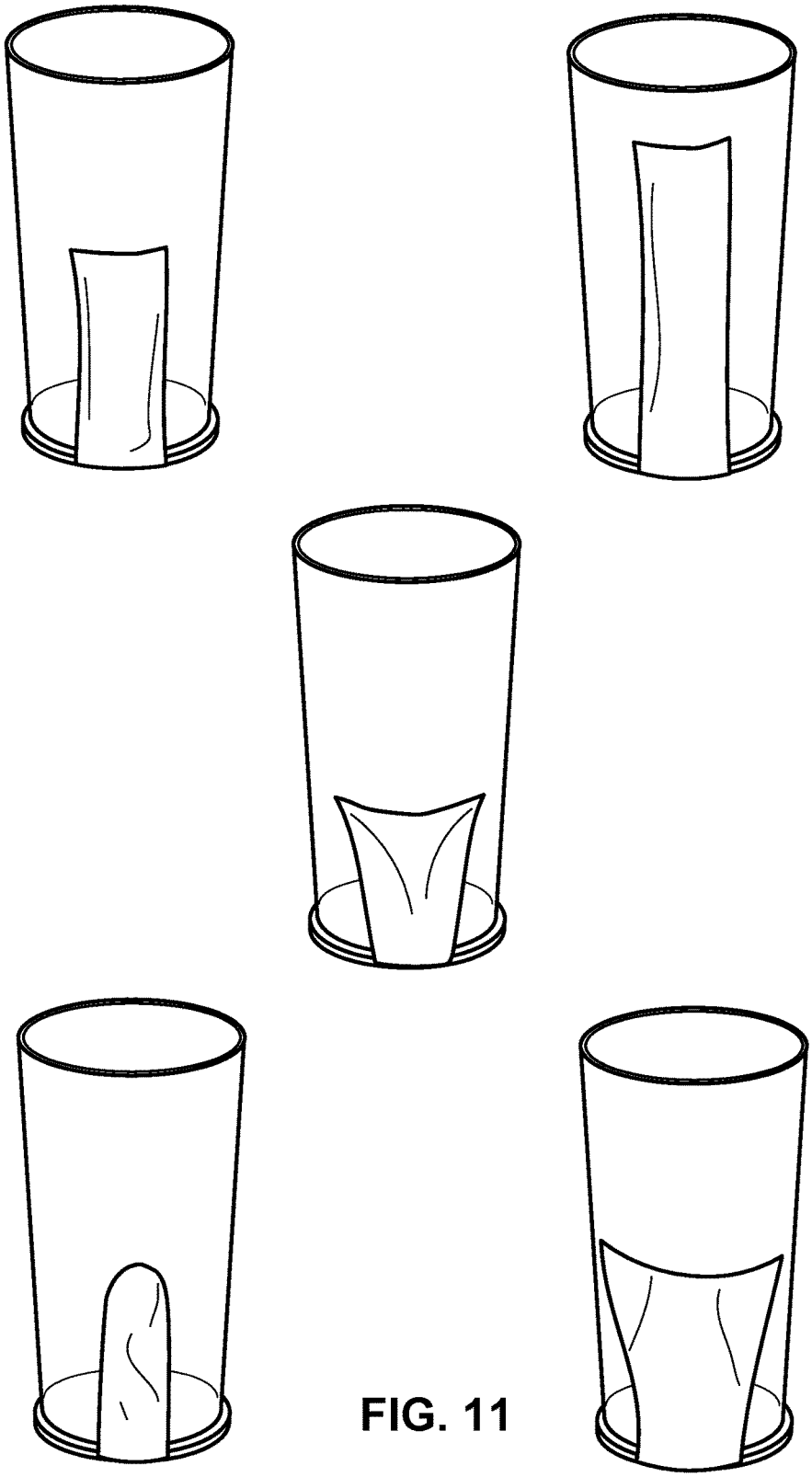
FIG. 11 is a perspective view of containers bearing bottom covers with tabs.

Five different example configurations of tabs of the bottom cover are shown in FIG. 11.

In some cases, the bottom cover can be formed integrally with the cup or otherwise configured in such a way that the bottom cover or the cup or both can be manipulated (or simply respond to suction applied to the top of the cup) to form an opening (such as a slit or intersecting slits) for the ambient air to reach the bottom of the blob.

In some implementations, the bottom cover can include a slit or cross slits or other mechanism that enables the user to form an opening in the bottom cover that allows the ambient air to reach the bottom of the blob, so that removing the bottom cover is not necessary.

Top Cover

Figure 5:
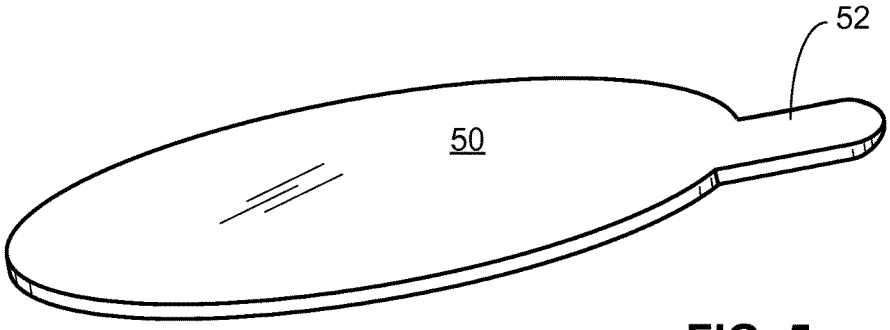
FIG. 5 is a perspective view of a top cover.

As shown also in FIG. 5, in some cases, the top cover 50 of the cup is a flexible round seal having the same diameter as the outer diameter of the top of the cup. The top cover can be attached to the top of the cup using an adhesive that provides an airtight and liquid tight seal of the top of the cup and allows the top cover to be peeled away from the top of the cup when the user is ready to suck the blob out of the cup. The top cover of the cup has a flexible tab 52 that can be grasped and pulled by the user in order to peel the top cover away from the top of the cup. The top cover can be die cut from flexible aluminum foil that is extremely thin to, for example, 1 mm thick. The top cover can be made from a material that is approved for use with foods and medicines.

The top cover can have any of a wide variety of shapes, sizes, materials, layers, markings, adhesives, and tabs. In some implementations, the top cover can be broader than the top of the cup to provide a broader area for marking, for example. The top cover can have a different shape than the top of the cup, for example, a square cover for a round top, or a round cover for a square top. The top cover need not be flexible or peelable and need not be attached by adhesive. In some cases, the top cover can be rigid or semi-rigid. In some implementations, the top cover can be attached by a slide coupling or a screw coupling or a hinge coupling to the top of the cup.

Any approach to providing a top cover that is removable or reconfigurable to allow the user to apply suction to the top of the blob or the space above it could be used. The top cover can be in the form of a breakable seal or alterable seal or puncturable seal so that the seal can remain on the top of the cup and so that an opening or pathway for suction to reach the top of the blob can be formed by an action of the user such as pushing on or otherwise manipulating all or a portion of the top cover. Any arrangement that covers the top opening sufficiently to keep the blob in place and also allows for suction to pass through to apply suction to the top of the blob or the space above it can be used, including arrangements that require the user to manipulate or otherwise act on the top cover.

The top cover can have a variety of features designed to enable the top cover to be peeled away or removed easily. These features can include a tab 41 which can have a variety of shapes, sizes, materials, and configurations. In some cases, the tab can be arranged to provide an indication that the cup has not been opened and therefore the blob has not been replaced or adulterated. For example, the tab can take the form of a long strip that extends from the top cover, is bent to extend along the side wall of the cup, and extends under the bottom cover, or is glued over the bottom cover. In such configurations, if the bottom cover has been removed and replaced, that fact may be apparent from the fact that the tab of the top cover has been tampered, removed, or broken. There can be two or more tabs that are features of the top cover and arranged in various ways. The tab or tabs can have materials, layers, or rigidities that differ from the main part of the top cover.

In some cases, the top cover can be formed integrally with the cup and configured in such a way that the top cover or the cup or both can be manipulated to form an opening (such as a slit or intersecting slits) for the ambient air to reach the top of the blob.

Sometimes, the top cover, the bottom cover, and the tab or tabs can be fabricated as a single integrated unit or a unit assembled from pieces. In use, the top or bottom cover of such a unit could be removed first and then the other cover, with the two covers remaining connected by the tab or tabs.

In some instances, it may be possible to make the container, both covers, and the tab as a single unit.

Among other things, using both the top cover in a bottom cover on the container conceal a container from ambient air so that the blob does not melt, disintegrate, or become dirty or contaminated, for example. Similar protection can be provided by enclosing a delivery unit in a sealed package, as discussed below.

Labels

Here we describe labels for the container, the top cover, the bottom cover, packaging, and other components. We use the term "label" broadly to include, for example, any thin device that can be attached to another component and bears information or codes; we also use the term to apply to any indicia that is marked on or formed on any of the components, for example, by printing, engraving, incising, branding, coloring, or any other technique.

Figure 6:
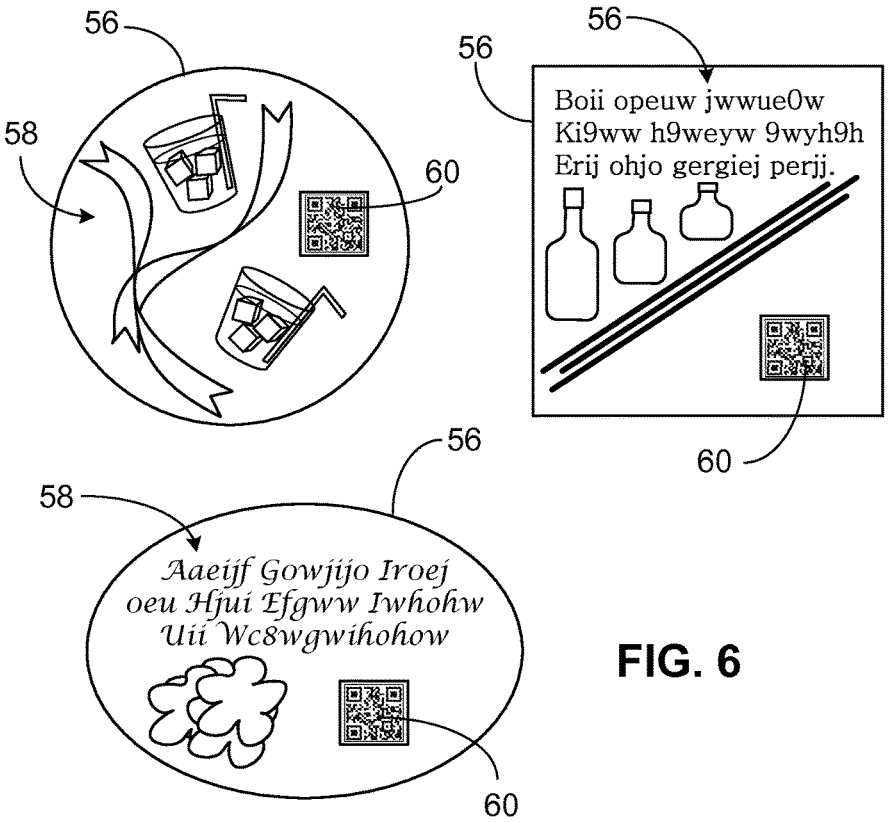
FIG. 6 shows top views of three examples of labels.

As shown also in FIG. 6, in some implementations, one or more labels 56 can be attached to the bottom cover, the top cover, the inner surface or outer surface of the cup, or any of the other elements used to implement our concepts, including the packaging, software, ingredients, or kits. Each of the labels can include marked information 58 about the trade name, price, ingredients, method of use, warnings, online addresses, and nutritional information, or combinations of those and other kinds of information.

Each of the labels can include a machine-readable symbol 60, such as a QR code, that can be read by a scanner or a smart phone. The machine-readable symbol can encode data directly and can include data that represents references to other places (for example, online) where other data is stored. More information about the data is described below. The marked information 58 can be marked on the inside or the outside of the top cover or the bottom cover or on the inside or the outside of the cup. The marked information can be placed and arranged so that it can be easily scanned or read by a smart phone or other electronic reader.

The QR code and other coded data or other information on the labels can be unique to the delivery unit, or can be the same for and associated with all of the delivery units belonging to a group of delivery units, such as the units in a given multiple unit package, or the units distributed at a particular event, or the units containing a particular formula or production batch of a drink or a medicine.

In some cases, the QR code can be used by the app to direct the user immediately to a social networking site such as Facebook or Twitter or Google+ or to an email or texting app running on the mobile device. The user then can use such a site or app to tell others about the delivery unit, the blob, or the event, for example.

When the blob within the container contains alcohol (or another potentially risky material), the markings—on the labels, the covers, the containers, or other components—can provide indications of the degree of the risk associated with the alcohol based on the percentage of the blob that constitutes alcohol. For example, the top cover can be marked in color (or text or both) indicating the percentage of alcohol in the blob. For example, green could indicate 10% alcohol, yellow could indicate 20% alcohol, and red could indicate 30% alcohol. Typically, the blob would not contain more than 30% alcohol.

The labels can have a wide variety of shapes, sizes, colors, configurations, typography, design, content, and combinations of them. More than one label can be provided for a given delivery unit.

In some implementations, each label or the container or one of the covers can bear a mark or identification of a control number for purposes of quality control of medical dosages or of edible dosages.

Packaging

Figure 7:
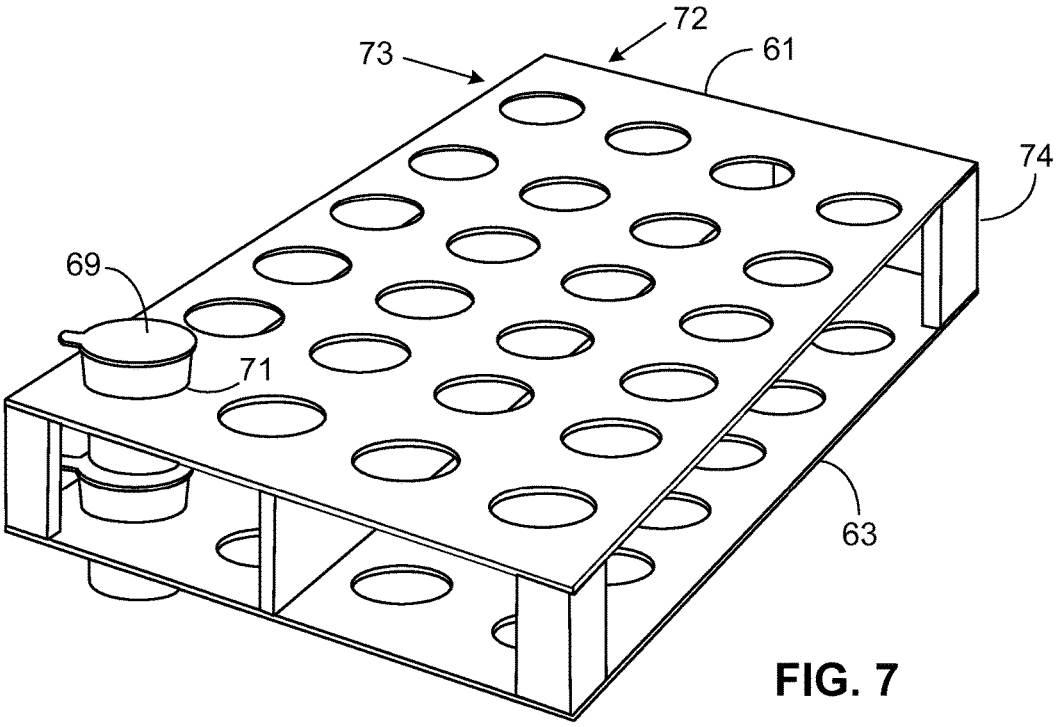
FIG. 7 is a perspective view of a tray and a container.

As shown in FIG. 7, in some cases, multiple delivery units 69 of the cup containing the blob can be packaged in compartments 71 arranged in rows 72 and columns 73 of a tray 74 for delivery at the place where the blobs are to be consumed or for transporting from a place where the units are assembled to locations from which they are distributed. There can be five rows and five columns for 25 cups or two rows and five columns for 10 cups for example. The tray can have a top sheet 61 spaced above a bottom sheet 63, and round holes in the top sheet having diameters of, for example, 1 inch, can receive and hold the cups in place. In some implementations, the bottom sheet 63 can have similar round holes to hold additional units, and the vertical spacing of the two sheet 61 and 63 can be arranged to avoid interference between delivery units in the top sheet and delivery units held in the bottom sheet.

Figure 8:
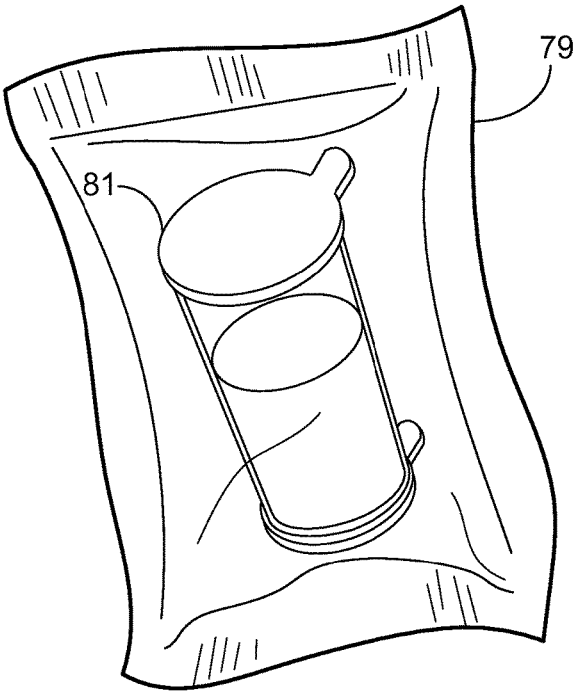
FIG. 8 is a side view of a package containing a delivery unit.

As shown in FIG. 8, in some implementations, in addition to packaging multiple delivery units of the cup as explained above, individual delivery units of the cup 81 containing the blob can be packaged (for example, in a sealed package 79) to protect the delivery unit, keep the delivery unit clean, and provide assurance to the user that no tampering of the delivery unit has happened. The packaging of an individual delivery unit can be in the form of a sealed wrapper.

Packaging for each delivery unit and for groups of delivery units can take a wide variety of shapes, forms, configurations, materials, sizes, colors, and other characteristics and combinations of them. Packaging can also be designed for multiples of individual components, such as containers or labels or covers or combinations of them.

Single delivery units, kits, and multiple delivery units, and other combinations of components can also be packaged without blobs held in the cups, for later filling.

Kits

Figure 9:
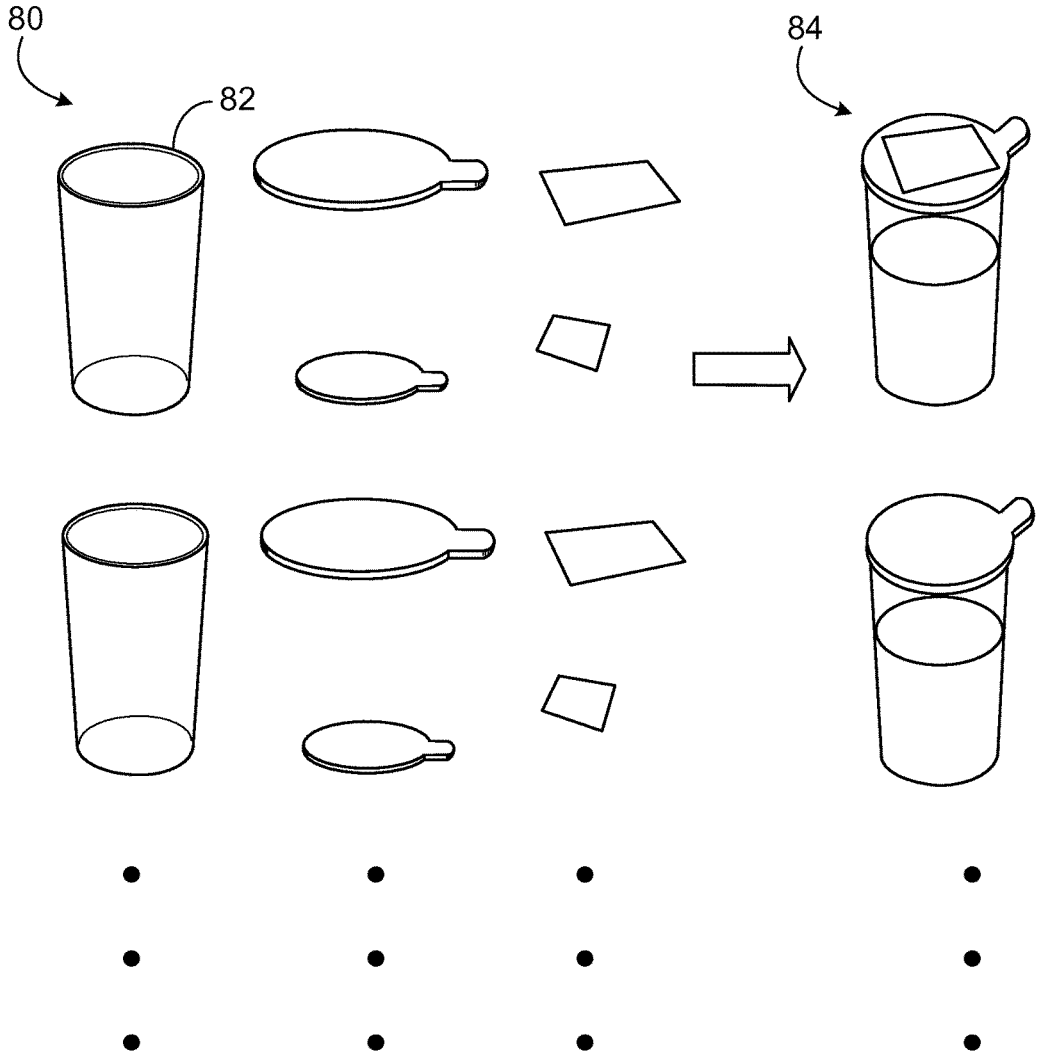
FIG. 9 is a schematic view of a kit and resulting delivery units.

As shown in FIG. 9, in some implementations, a kit 80 can include components 82 useful or necessary to produce one or more delivery units 84. For each delivery unit, a kit could include a container, a top cover, a bottom cover, labels, dry ingredients to be dissolved to produce the precursor for a blob, and packaging, for example. Multiple units of each of the components could be provided to enable the user to make and package multiple assembled delivery units.

A wide variety of kits can be produced having a wide variety of components and multiples of components. Different kits can be produced that can be used together to fabricate one or more delivery units.

In some implementations, the containers in the can be supplied with bottom covers already attached to illuminate the step of requiring the user to attach a bottom cover before pouring liquid into the container.

Ingredients

In some implementations, packages 86 of pre-mixed dry ingredients to be mixed with liquor or other alcohol or water or other liquid can be provided for use in mixing volumes of liquid to be used in forming the blobs. Once mixed, the volumes of liquid can be used in filling the cups, which can then be refrigerated or otherwise treated so that the liquid forms blobs. The dry ingredients included in the package can be all of the ingredients necessary for the blob to be included in a finished delivery unit, including appropriate flavors, except for the liquid.

Pre-mixed dry ingredients can be provided in a variety of package sizes including packages that are small enough for a single finished delivery unit and packages that are large enough to produce a large number of finished units.

Manufacture

In some cases, manufacturing of the delivery units can proceed as follows. A liquid material that is the precursor to the blob can be formed by using a selection of ingredients that can include premixed dry ingredients, for example. In some cases, the ingredients can be liquid. When some of the ingredients are dry, liquid must be added to dissolve the ingredients. Liquid ingredients can include water or alcohol or fruit juice or combinations of them, for example. Dry ingredients can include sugar, salt, or powdered gelatin, or combinations of them, for example.

The precursor liquid material can be stored temporarily or over a long period of time or may be used immediately. When a cup or container is to be loaded with an appropriate amount of the precursor liquid material, a bottom cover or some other device for sealing the bottom of the container is first put into place so that when the precursor liquid material is poured into the container, it is held there. As noted earlier, in some cases the containers can be supplied with the bottom covers already glued on. The bottom cover can be the final bottom cover or could be a temporary bottom cover. The appropriate amount of precursor liquid material can vary widely. Suitable amounts could be 1 ounce, 2 ounces, or amounts in the range between ¼ ounce and 5 ounces, for example.

In some cases, a mixing vessel can be provided in which to mix and from which to fill a large number of containers. For example, the vessel could hold enough mixture dry ingredients and liquid for 25 finished delivery units. The vessel could be marked at appropriate levels corresponding to a volume of liquor or alcohol and a volume of water to be used in the mixing. For example, a marking on the vessel could indicate a level corresponding to 25% by volume of liquor or alcohol and 75% by volume of water. 25 portions of mixed dry ingredients could then be put in the vessel and the alcohol and water components added according to the markings.

After the precursor liquid material in this suitable amount has been loaded into the bottom each of the containers, a gelling action is applied. The gelling step could include refrigeration or simply the passage of time (say ten minutes or 30 minutes) in the case of a gelling agent that gels at room temperature without further intervention. The gelling agents and the manner in which they are triggered to gel the blob can vary widely and be based on a variety of chemical, mechanical, or thermal mechanisms.

Once the blob has been gelled, a top cover can be applied to seal the container, if the blob is not to be consumed promptly.

If labeling information is not already included on the top cover or the bottom cover, or even if it is, additional labels can be attached to the top cover, the bottom cover, or the container.

The finished delivery unit then can be packaged. In one level of packaging, a single delivery unit is wrapped in a sealed package for delivery to the consumer. In some implementations, two or more delivery units can be packaged together. In some cases, two or more delivery units can be placed in a tray for serving or delivery to one or more consumers. Then the tray can be packaged. Labels can be attached to the tray or the packaging of the tray or both.

The individual delivery units or groups of them can then be placed into the distribution channel to reach the consumer.

Fabrication of individual delivery units or groups of them can be done by private individuals for private use or for use at parties and events, by caterers, by bartenders, by distributors, by pharmacists, by wholesalers, or by original manufacturers. For example, a liquor manufacturer or a pharmaceutical manufacturer could produce prepackaged trays for distribution.

Software and Hardware

Figure 10:
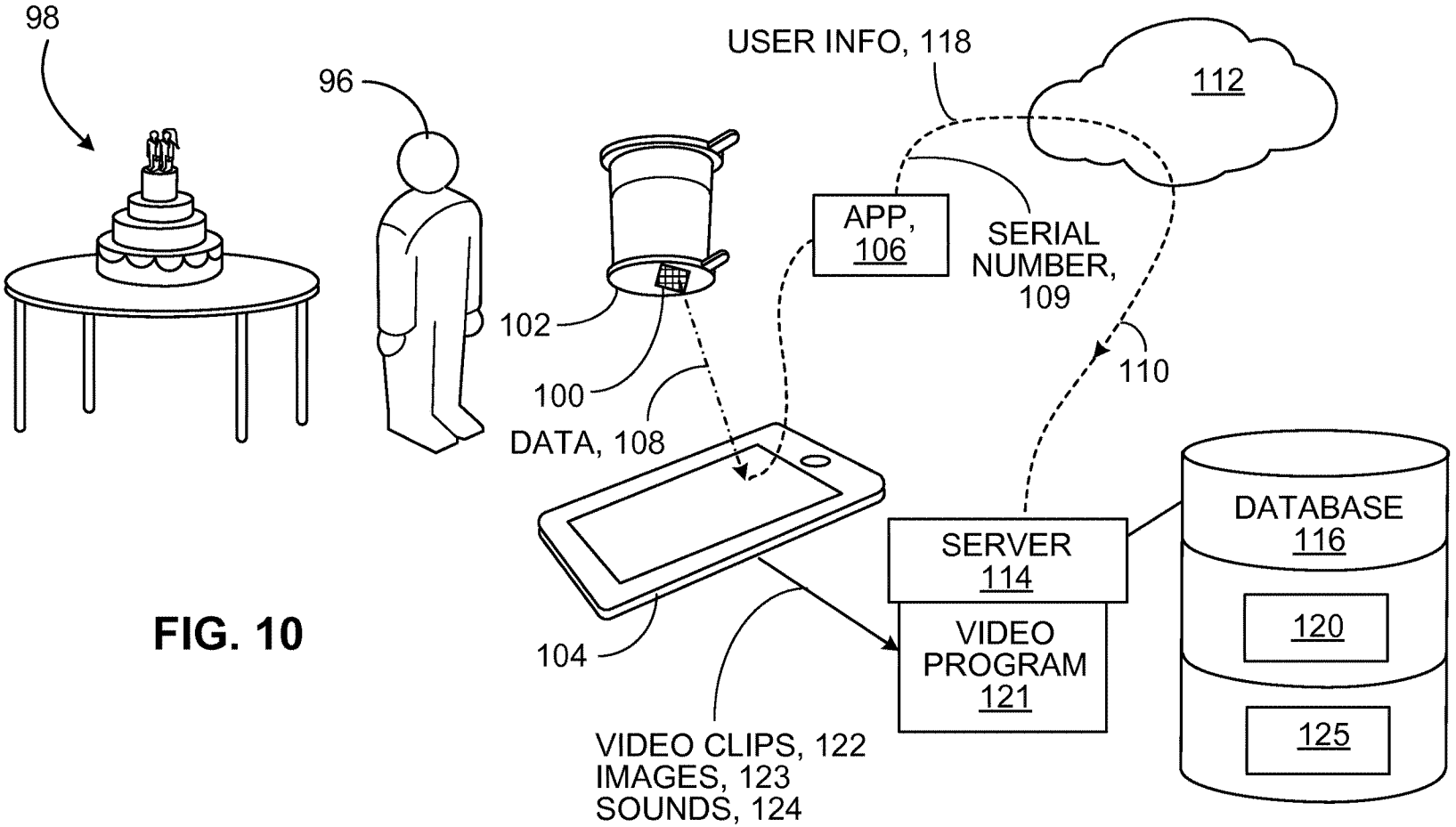
FIG. 10 is a block diagram of software and hardware.

As shown in FIG. 10, in some examples, the user of a delivery unit can use a local mobile device or other mobile or stationary device; a program, a mobile app, or other computer software; a communication network; and digital storage either at a local device or at a central server to engage in activities related to the use of the delivery unit. Said another way, the use of the unit can be enhanced by software and hardware associated with the user or with the context in which the unit is to be used or both.

In some examples, a user 96 attending, say, a wedding reception 98 can scan the QR code 100 on the bottom cover 102 of one of the delivery units using a smart phone 104. An app 106 installed by the user and running on the smart phone can capture data 108 from the QR code. The data 108 can be unique to the particular delivery unit that bears the QR code, for example a unique serial number 109. The app running on the smart phone can send the unique serial number in a communication 110 over a cellular telephone network 112 to a central server 114 that maintains a database 116.

The app can send to the central server information about the user of the smart phone (assuming the user has entered information 118, say to register). Based on the unique serial number, the server can look up in the database information 120 that can include the manufacturer of the delivery unit, the date of manufacture, the name or title of the blob that is in the delivery unit (for example, the name of an alcoholic drink), the ingredients contained in the unit, an identification of the wedding reception for which the delivery unit was created, a wide variety of information associated with the wedding reception, or other information and combinations of information.

In addition, the server can add to the database information 125 about the user and the use of the delivery unit. For example, the server could add information about the user that the user had entered on her smart phone, such as her name, address, age, gender, and preferences, among other things. The server could also add information about the time of the communication, the identity of the smart phone, the location of the smart phone, or other information or combinations of information. The information contained in the database 116 can then be provided to and used by the user, the manufacturer, the distributor, the caterer, the smart phone user, other participants in the wedding (assuming their access to the information is permitted by the smart phone user), and others.

In some instances, the program, or the mobile app, or a browser running on the smart phone (or other mobile device) could engage the user in a game, an interaction with other users, an educational exercise, or another activity, or a combination of activities. Such an activity can have features that relate to the blob, the delivery unit, the user, or the event, or a combination of two or more of them.

A wide variety of such activities and features are possible.

In some implementations, a user of one of the delivery units could provide feedback about the blob. The feedback could be in the form of a satisfaction survey response or a much simpler format. One or more of the labels on the delivery unit could invite the user to provide feedback, perhaps with a legend of the kind that would read "please read our drink." The feedback could be given electronically through the user's mobile device. For example, the user can scan the QR (or other) code on the delivery unit. An app running on the mobile device could then display a survey form. When the user completes the form, the mobile device could send the results to a server. In a very simple version, when the user scans the code, the mobile device could present a simple choice between a "thumbs-up" or "thumbs down" or between a "like" or "do not like" choice. In some cases the feedback could be in the form of a ranking. In addition, text feedback could be provided by the users.

The server can accumulate feedback data from a very large number of users and delivery units and could associate the feedback with information about the delivery units, such as the flavor, name, manufacturer, quantity, ease-of-use, and any combination of those in a wide variety of other factors. The feedback data could also be associated with the demographic characteristics of the users. The feedback can be accumulated, aggregated, analyzed, and distributed to manufacturers, distributors, servers, and a wide variety of other parties.

Feedback and the resulting analytics of this kind could be very fine-grained and very accurate because it is provided at the moment at which the delivery unit is consumed.

More generally, this approach to accumulating user feedback could be applied to any kind of food or other product that is consumed by a user, for example, as a single consumable unit, in a context in which the user might be willing are interested in providing such feedback. Products of this kind could include canned or bottled beverages, candy bars, magazines, newspapers, cosmetics, and pharmaceuticals, for example.

In some implementations, for example, a guest at a wedding could be invited by a centrally running video editing and production program 121 to capture a video or a series of video clips 122 or images 123 or sounds 124 of the wedding reception and upload them to the central server. The program 121 could then automatically edit and combine the clips (along with other images, text, or video clips, for example, of the married couple) into a short edited video of the reception or other content presentation and return it immediately to the user at the reception and to other users (who have similarly registered through their mobile devices at the reception).

In some cases, two or more different users can provide clips, images, and text either independently or through a social networking medium for use by the program 121. The program 121 then could edit and combine content from different users either automatically or with the assistance of one or more of the users to produce finished presentations to be provided to one or more of the users. In this way, the social aspects experienced by participation in an event can be enhanced and translated into online social activities related to the event.

Because the program 121 can be aware of the user or users who have provided content items for inclusion in a presentation, the program 121 can insert items of content into a presentation that are not directly received from the user.

Such items of content could include text, for example, a banner that reads "Congratulations and best wishes for a long and happy life. Nissim Shani." In some cases, the program 121 could insert other items of content, such as a previously stored photograph of the user.

In some instances, a user could register through her mobile device with the server for a prize.

In some cases, when the blob contains a medicine, the user could learn information about the medicine or about a medical condition or about medical care providers by scanning the QR code and watching or listening to corresponding content returned from a central server.

Useful data 124 can be accumulated and stored in the database of the central server that ties coded identifiers (e.g., serial numbers) of delivery units with a wide variety of other information about the delivery units, events, users, and other contextual information. Such data can be aggregated and analyzed to produce statistical data that is useful for marketing, product formulation, and other purposes. For example, the statistical data could correlate the locations of use of a given flavor of blob with the frequency of consumption, or the times of the day when blobs containing a particular medicine are ingested, or the elapsed time between the manufacture and use of delivery units by product.

Analytics

As discussed above, a wide variety of information can be accumulated about the delivery units, the users, and their uses. The information can include, for example, information that describes the delivery unit, information that describes the context of its use, information related to the user, information that describes the use, information related to marketing and distribution of delivery units, among other things. The information that describes the delivery unit can include the source, the manufacturer, the place of manufacture, the batch, control number, ingredients, formula, date of manufacture, expiration date, size, and other information. The information that describes the context of its use could include the identification of an event, the location, the type of event, the name of a restaurant or bar, or other information. The information related to the user can include name, age, address, contact information, association with the event or a host of the event, social network relationships with other users, and other information. The information that describes the use of the delivery unit can include the person who consumed it, the place of use, the time of use, and other information. The information about marketing and distribution delivery units can include information about promotions, advertising, unit volumes, geographic distribution, and other information.

A wide range of analytics can be applied to the information to generate analytical results. Among the things that can be analyzed are the demographics of people who use the distribution units; the locations, events, types of establishments, and times of consumption; the popularity of various formulations, products, ingredients, types of containers, types of packaging, and other aspects of the manufacture and distribution of the delivery units; and you and other results.

Other implementations are within the scope of the following claims.

The invention claimed is:

1. An apparatus comprising a clear plastic shot glass having two spaced apart parallel round open ends of different diameters and a connecting wall having a round cross-section that tapers uniformly from one of the open ends to the other of the open ends, the taper having an angle of 5 to 15 degrees to a line that is perpendicular to either of the round open ends, the narrower open end bearing a ring-shaped flat flange that projects inwardly toward a central axis of the shot glass and provides a flat ring-shaped surface that faces away from the broader open end, the broader open end having a round rim that faces away from the narrower open end, a gelled mass that includes alcohol and is in contact with an inner surface of the tapered wall of the shot glass to provide a seal to prevent air from passing from one of the open ends to the other open end, a tabbed peel-away cover sealed to a round rim at the broader open end, and a tabbed peel-away cover sealed to the flat ring-shaped surface at the narrower open end, the gelled mass being in contact with an inner surface of the cover sealed to the flat ring-shaped surface at the narrower open end, and a space between the gelled mass and an inner surface of the cover sealed to the round rim at the broader open end.

2. The apparatus of claim 1 comprising scannable markings on the shot glass or on at least one of the covers, the markings comprising information associated with the gelled mass.

3. The apparatus of claim 1 comprising other shot glasses, and a delivery tray containing the shot glass and the other shot glasses.

4. The apparatus of claim 1 in which the gelled mass comprises a mixed drink.

5. The apparatus of claim 1 comprising a code on one or the other of the covers or both of the covers.

6. The apparatus of claim 1 comprising an interface between the inner surface of the tapered wall of the shot glass and an outer surface of the gelled mass that enables the gelled mass to be released as an integral mass from the shot glass when a user sucks on the broader open end.

7. The apparatus of claim 1 in which the broader open end is configured to enable a user's lips to be sealed around the broader open end to apply suction to the space within the container.

8. The apparatus of claim 1 in which the gelled mass comprises flavoring components.

* * * * *